US006170475B1

(12) United States Patent
Lewis et al.

(10) Patent No.: US 6,170,475 B1
(45) Date of Patent: Jan. 9, 2001

(54) METHOD AND SYSTEM FOR DETERMINING CYLINDER AIR CHARGE FOR FUTURE ENGINE EVENTS

(75) Inventors: Donald J. Lewis, Brighton; Mrdjan J. Jankovic, Birmingham; Stephen William Magner, Lincoln Park; Giuseppe D. Suffredini, Shelby Township, all of MI (US)

(73) Assignee: Ford Global Technologies, Inc., Dearborn, MI (US)

( * ) Notice: Under 35 U.S.C. 154(b), the term of this patent shall be extended for 0 days.

(21) Appl. No.: 09/258,924

(22) Filed: Mar. 1, 1999

(51) Int. Cl.[7] ..... F02M 25/07
(52) U.S. Cl. ..... 123/568.21; 701/108; 73/118.2
(58) Field of Search ..... 123/478, 480, 123/488, 568.11, 568.21; 701/101, 103, 104, 105, 108; 73/117.3, 118.1, 118.2; 702/94, 95, 98

(56) References Cited

U.S. PATENT DOCUMENTS

| | | | | |
|---|---|---|---|---|
| 4,512,318 | | 4/1985 | Ito et al. . | |
| 4,548,185 | * | 10/1985 | Pozniak | 701/108 |
| 4,987,888 | | 1/1991 | Funabashi et al. . | |
| 4,999,781 | * | 3/1991 | Holl et al. | 701/108 |
| 5,068,794 | | 11/1991 | Hosaka . | |
| 5,159,914 | * | 11/1992 | Follmer et al. | 123/478 |
| 5,270,935 | | 12/1993 | Dudek et al. . | |
| 5,273,019 | | 12/1993 | Matthews et al. . | |
| 5,274,559 | * | 12/1993 | Takahashi et al. | 701/103 |
| 5,293,553 | * | 3/1994 | Dudek et al. | 73/118.2 |
| 5,297,064 | * | 3/1994 | Bauerle | 702/98 |
| 5,331,936 | | 7/1994 | Messih et al. . | |
| 5,398,544 | | 3/1995 | Lipinski et al. . | |
| 5,497,329 | | 3/1996 | Tang . | |
| 5,537,977 | | 7/1996 | Hartman et al. . | |
| 5,654,501 | | 8/1997 | Gruzzle et al. . | |

FOREIGN PATENT DOCUMENTS

| | | |
|---|---|---|
| 0 365 003 | 4/1990 | (EP) . |
| 2 333 159 | 7/1999 | (GB) . |
| 040012148 | 1/1992 | (JP) . |

* cited by examiner

*Primary Examiner*—Willis R. Wolfe
(74) *Attorney, Agent, or Firm*—Allan J. Lippa

(57) ABSTRACT

A method and system for determining future cylinder air-charge of an internal combustion engine having a throttle plate and an intake manifold includes a throttle position sensor for sensing a current position of the throttle plate. Control logic determines a future position of the throttle plate based on the sensed current position. Based on a model governing a change in pressure of the intake manifold and the future position of the throttle plate, the control logic then determines the future cylinder air charge.

20 Claims, 4 Drawing Sheets

METHOD AND SYSTEM FOR DETERMINING CYLINDER AIR CHARGE FOR FUTURE ENGINE EVENTS

TECHNICAL FIELD

This invention relates to methods and systems for determining cylinder air charge for future engine events.

BACKGROUND ART

Optimum efficiency of a three-way catalyst is achieved when a spark ignited internal combustion engine operates at stoichiometry (i.e., ideal air-to-fuel ratio). This requires that the in-cylinder air charge (i.e., mass flow rate of air into the cylinder) be matched by an appropriate amount of fuel. At each engine event, in-cylinder air-charge is typically estimated based on the measurements from a throttle mass air flow (MAF) sensor or an intake manifold pressure (MAP) sensor.

However, the present air-charge estimate, which pertains to the cylinder presently on the intake stroke, is several (typically one or two) engine events late for a fueling decision. This happens because the optimal timing for fuel injection in port fuel injection engines is on the closed intake valve. Moreover, dispensing the fuel takes a finite amount of time and larger quantities at higher engine speed may not be dispensed in one event or less. Thus, the amount of fuel decided at time t will be dispensed into the port of a cylinder that is to start its intake several engine events into the future. An improvement in the ability to control air/fuel ratio will follow if future values of cylinder air-charge can be predicted based on the present and past measurement of engine operating conditions. Because measurement noise has detrimental effect on the accuracy of prediction, the challenge for the designer is to provide a system that responds fast to legitimate changes in the signals being measured, yet is robust against inevitable measurement noise.

Several methods have been established that predict air charge for future cylinder events. For example, U.S. Pat. No. 4,512,318, issued to Ito et al., discloses a method for correcting the fuel injection flow rate in order to obtain an ideal air/fuel ratio. A "correction coefficient" (a multiplier for the base fuel injection time) is determined based on the rates of change of the currently measured intake manifold pressure and throttle valve position signals.

Similarly, a second known method disclosed in U.S. Pat. No. 5,497,329, issued to Tang, addresses a method of predicting air mass induced into each cylinder based on a predicted value of MAP. The predicted value of MAP is based on the rates of change of the intake manifold pressure signal and the sensed throttle position. These methods are signal-based, non-recursive predictors. These methods fail to take into account the available model of the manifold filling dynamics thereby making the predictions sensitive to noise and prone to overshooting.

A prediction method based on the theory of Kalman Filtering has been disclosed in U.S. Pat. Nos. 5,270,935 and 5,273,019, issued to Dudek et al. and Matthews et al., respectively. Kalman filters are designed for linearized models obtained by standard least squares identification. The algorithms disclosed therein are "absolute" predictors wherein the modeling errors affect the predictions in steady state.

DISCLOSURE OF INVENTION

It is an object of the present invention to provide a method and system for determining cylinder air-charge one or more engine events into the future utilizing a method that does not affect predictions in steady state.

It is yet another object of the present invention to provide a method and system for determining future cylinder air-charge based on a predicted behavior of the engine.

In carrying out the above object and other objects, features, and advantages of the present invention, a method is provided for determining a future cylinder air charge for an internal combustion engine having a throttle plate for controlling the amount of air to be delivered to the engine and an intake manifold for receiving the air controlled by the throttle plate and for transferring the air into a cylinder. The method includes sensing a current position of the throttle plate, determining a future position of the throttle plate based on the sensed current position, determining a model governing a change in pressure of the intake manifold, and determining the future cylinder air charge based on the future position of the throttle plate and the model.

In further carrying out the above object and other objects, features, and advantages of the present invention, a system is also provided for carrying out the steps of the above described method. The system includes a throttle position sensor for sensing a current position of the throttle plate. The system also includes control logic operative to determine a future position of the throttle plate based on the sensed current position, determine a model governing a change in pressure of the intake manifold, and determine the future cylinder air charge based on the future position of the throttle plate and the model.

BEST MODE FOR CARRYING OUT THE INVENTION

Figure 1:
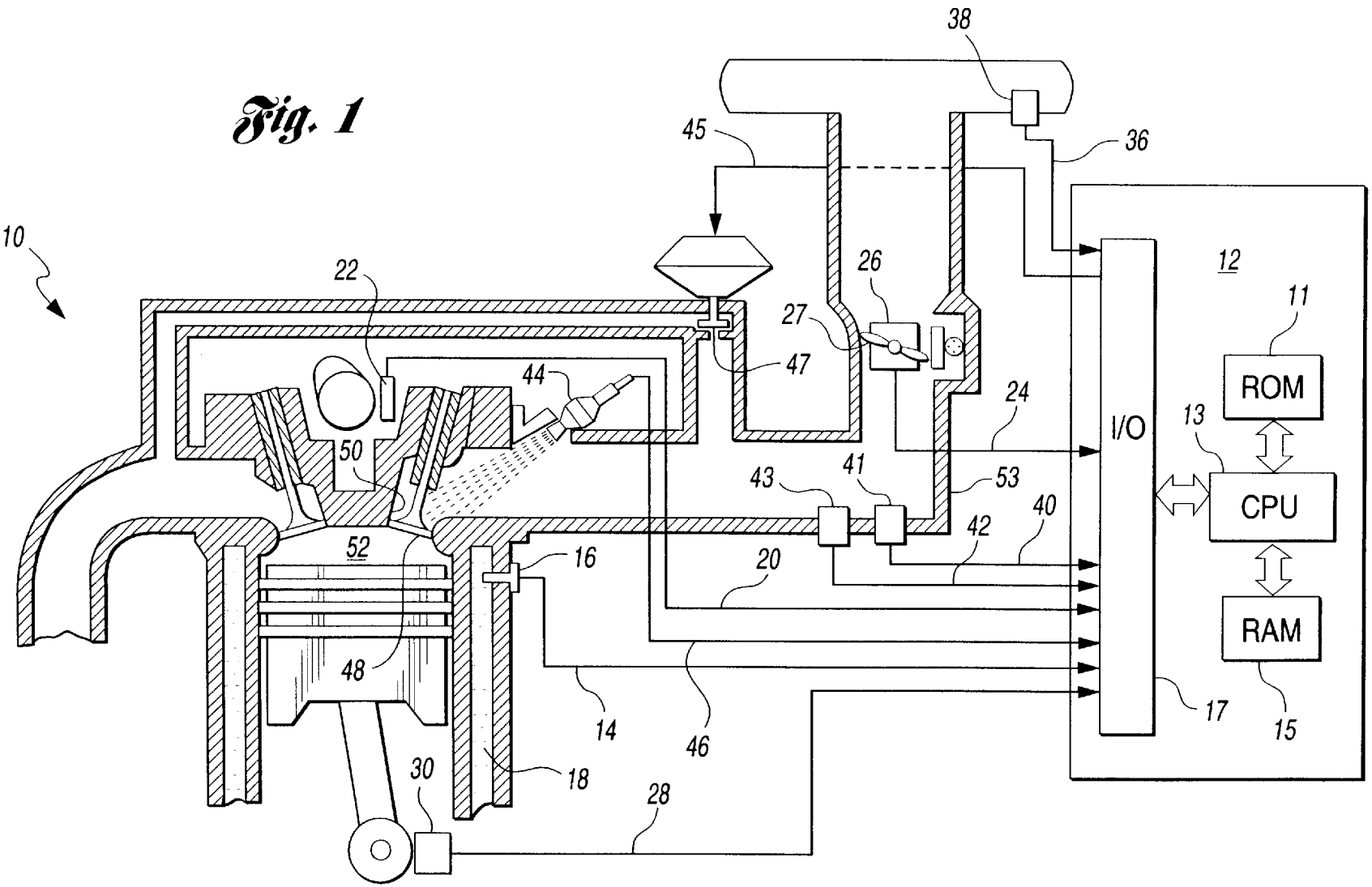
FIG. 1 is a schematic diagram of an internal combustion engine and an electronic engine controller which embody the principles of the present invention.

Turning now to FIG. 1, there is shown an internal combustion engine which incorporates the teachings of the present invention. The internal combustion engine 10 comprises a plurality of combustion chambers, or cylinders, one of which is shown in FIG. 1. The engine 10 is controlled by an Electronic Control Unit (ECU) 12 having a Read Only Memory (ROM) 11, a Central Processing Unit (CPU) 13, and a Random Access Memory (RAM) 15. The ECU 12 can be embodied by an electronically programmable microprocessor, a microcontroller, an application-specific integrated circuit, or a like device to provide the predetermined control logic. The ECU 12 receives a plurality of signals from the engine 10 via an Input/Output (I/O) port 17, including, but not limited to, an Engine Coolant Temperature (ECT) signal 14 from an engine coolant temperature sensor 16 which is exposed to engine coolant circulating through coolant sleeve 18, a Cylinder Identification (CID) signal 20 from a CID sensor 22, a throttle position signal 24 generated by a throttle position sensor 26 indicating the position of a throttle plate 27 operated by a driver, a Profile Ignition Pickup (PIP) signal 28 generated by a PIP sensor 30, a Heated Exhaust Gas Oxygen (HEGO) signal 32 from a HEGO sensor 34, an air intake temperature signal 36 from an air temperature sensor 38, an intake manifold temperature signal 40 and an intake manifold pressure signal 42 from manifold absolute pressure (MAP) sensor 43.

The ECU 12 processes these signals and generates corresponding signals, such as a fuel injector pulse waveform signal transmitted to the fuel injector 44 on signal line 46 to control the amount of fuel delivered by the fuel injector 44. ECU 12 generates an exhaust gas recirculation (EGR) signal 45 to control the opening of an EGR orifice 47. EGR orifice 47 is used to reduce the emission of nitrous oxides by cooling the combustion process.

Intake valve 48 operates to open and close intake port 50 to control the entry of the air/fuel mixture into combustion chamber 52.

Figure 2:
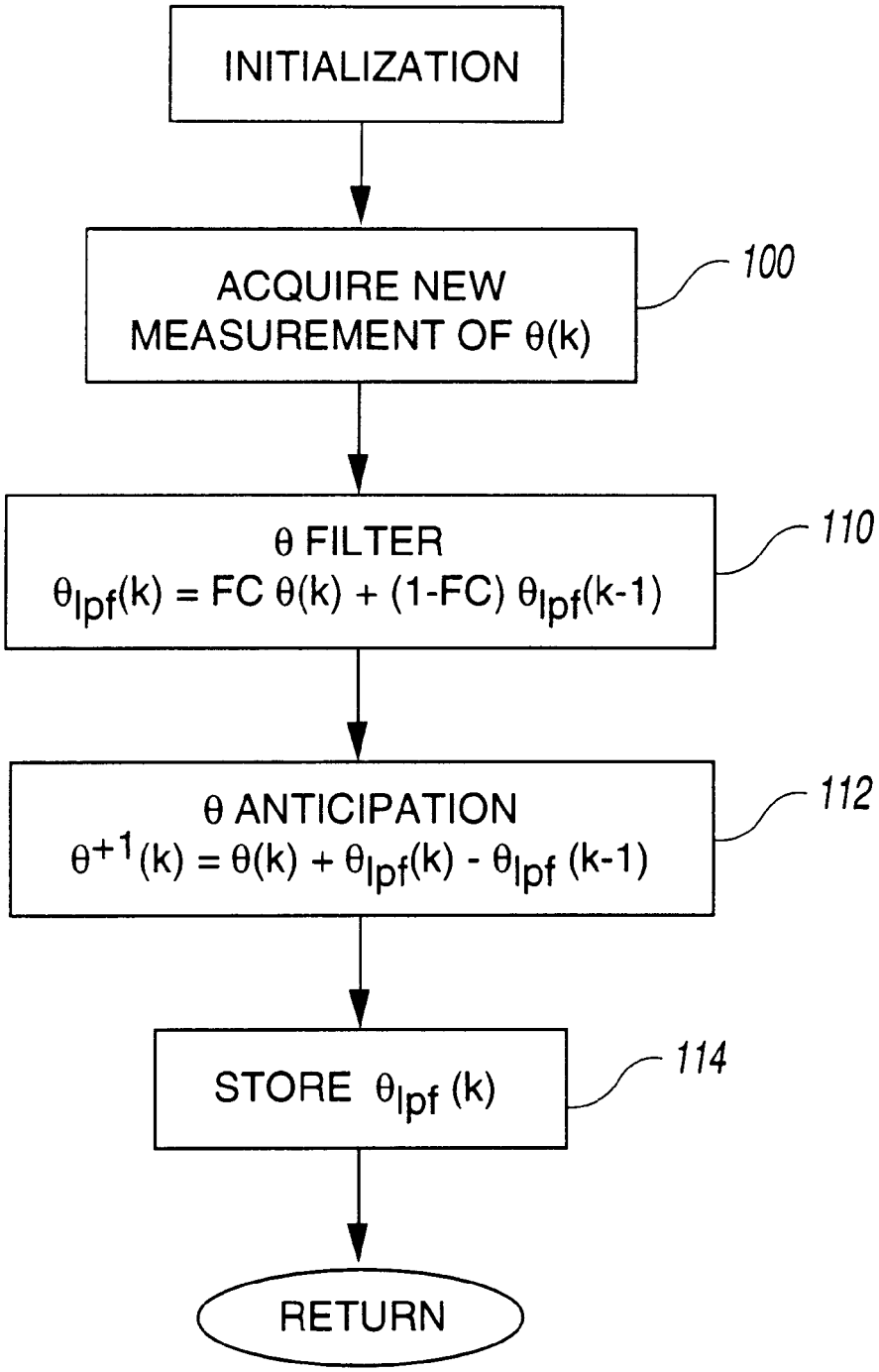
FIG. 2 is a flow diagram illustrating the general sequence of steps associated with determining a future position of the throttle valve.

Turning now to FIG. 2, there is shown a flow diagram illustrating the general sequence of steps associated with the step of determining a future position of the throttle plate 27. A simple method of using throttle information is to determine the difference between the present position of the throttle and the last engine event's throttle position. Assuming the difference in time between the next engine event and the present engine event will be the same as the difference between the present and last event, the future throttle position is assumed to be the sum of the present throttle position plus the difference between the present and last throttle position. This scheme works well if the throttle position signal is free of any noise. Thus, the first step is to sense/measure the current position of the throttle plate, as shown at block 100. The future throttle position can then be predicted as follows:

$$\theta^{+1}(k)=\theta(k)+[\theta(k)-\theta(k-1)]$$

$$\theta^{+1}(k)=2\times\theta(k)-\theta(k-1)$$

where:

$\theta$+1(k) is the estimate of throttle position at the next engine event;

$\theta(k)$ is the measured throttle position at the present engine event; and $\theta(k-1)$ is the measured throttle position at the previous engine event.

To attenuate the effect of measurement noise on throttle prediction a low pass filter is utilized at engine event rate, as shown at block 110. Taking the difference between the present and last output of the filter will provide a more accurate throttle rate of change than performing the operation without the filter. However, the filter creates a lag, both when the throttle starts and when it completes a change in position. The more emphasis placed on old information, the better filtered the signal, but the more the signal lags the true value.

A discrete approximation of the first order filter is as follows:

$$\theta_{LPF}(k)=[FC]\theta(k)+[1-FC]\theta_{LPF}(k-1)$$

where:

$\theta_{LPF}(k)$ is the present filtered value of the measured throttle position;

FC is the filter constant of the rolling average filter, which can take on values from 1 (no filtering) to 0 (value never updated). A time constant TC can be related to FC by:

$$TC=\frac{\Delta t(1-FC)}{FC}$$

which indicates that this type of event-based filter will have a time constant that varies with engine event rate $\Delta t$. Additional correction is possible to establish a fixed time constant, but in the interest of minimizing computational effort, will not be introduced here. Also, a fixed rate algorithm can be used to determine throttle rate, with the results scaled and applied to the event rate operation; and $\theta_{LPF}(k-1)$ is the last engine event's filtered value of throttle position.

The determination of the next future throttle position is determined, as shown at block 112, utilizing the present and last values of the filtered output as follows:

$$\theta^{+1}(k)=\theta(k)+[\theta_{LPF}(k)-\theta_{LPF}(k-1)].$$

Finally, the filtered throttle position value is stored for a subsequent determination, as shown at block 114.

Figure 3:
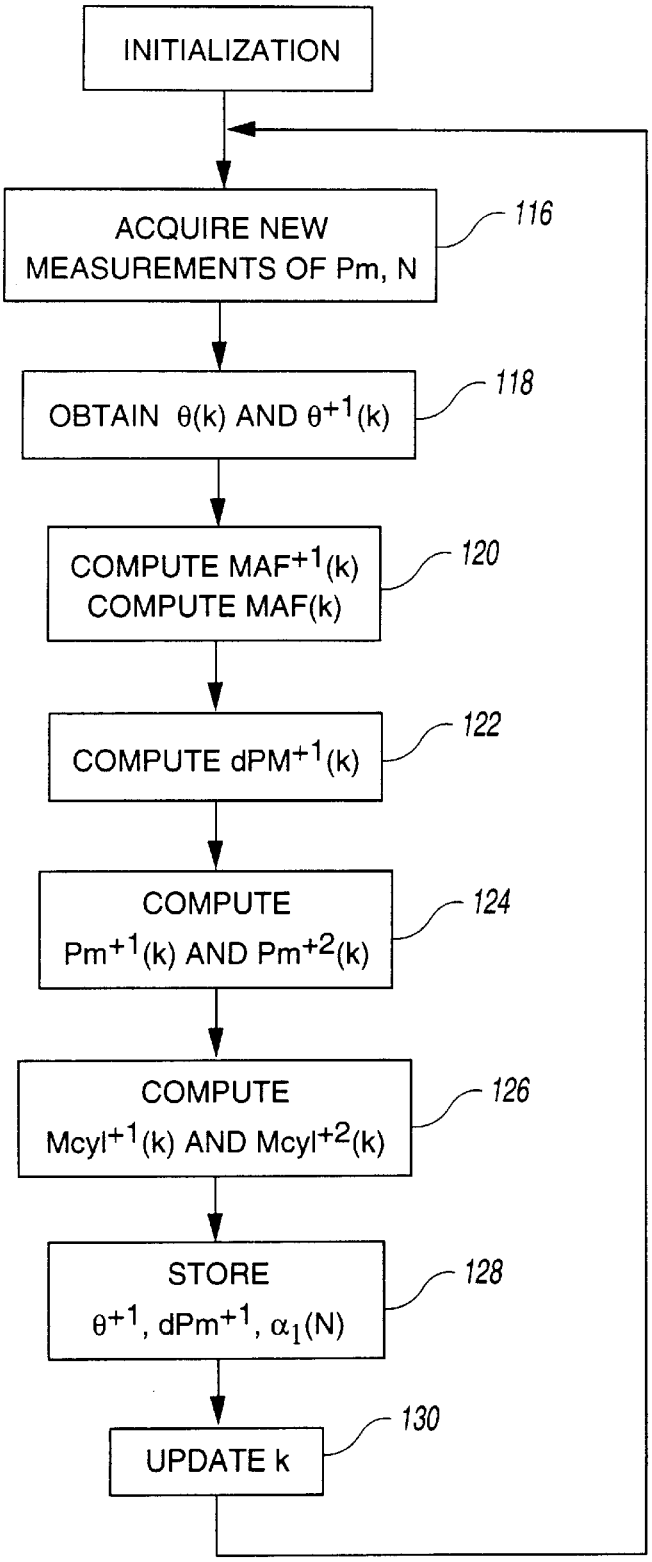
FIG. 3 is a flow diagram illustrating the general sequence of steps associated with determining the future cylinder air-charge when there is no external EGR.

Turning now to FIG. 3, there is shown a flow diagram illustrating the general sequence of steps associated with predicting the cylinder air charge for future engine events when no exhaust gas is recirculated into the intake manifold 53. That is, the gas in the intake manifold 53 is fresh air and the pressure in the intake manifold 53 is directly related to the cylinder air charge.

The signals typically measured in a speed density system include the throttle position, intake manifold pressure, intake manifold temperature and engine speed. In addition, ambient pressure and temperature are either directly measured or estimated. This method assumes that these signals are available.

In order to determine future cylinder air charge, we must first determine future intake manifold pressure, as will be described in greater detail in conjunction with blocks 116–124. The starting point is a standard dynamic model governing the change of pressure in the intake manifold as follows:

$$P_m=\frac{RT}{V}(MAF-M_{cyl})$$

where, T is the temperature in the intake manifold as sensed by intake manifold temperature sensor 41, V is the volume of the intake manifold, R is the specific gas constant, MAF is the mass flow rate into the intake manifold 53 and $M_{cyl}$ is the flow rate into the cylinder. The mass flow rate into the cylinders ($M_{cyl}$) is represented as a linear function of intake manifold pressure with the slope and offset being dependent on engine speed and ambient conditions as follows:

$$M_{cyl}=\alpha_1(N)P_m-\alpha_2(N)\frac{P_{amb}}{P_{amb_nom}}$$

where $P_{amb}$ and $P_{amb_nom}$ are the current ambient pressure and the nominal value of the ambient pressure (e.g. 101 kPa). The engine pumping parameters $\alpha_1$ (N) and $\alpha_2$(N) are regressed from the static engine mapping data obtained at nominal ambient conditions. After substituting this expression into the dynamic equation for intake manifold pressure and differentiating both sides to obtain the rate of change of the pressure in the intake manifold, we obtain:

$$\dot{P}_m = \frac{RT}{V}\left[\frac{d}{dt}MAF - \alpha_1\dot{P}_m - \dot{\alpha}_1 P_m - \dot{\alpha}_2\frac{P_{amb}}{P_{amb_nom}}\right]$$

Note that $$\dot{\alpha}_i = \frac{\partial\alpha_i}{\partial N}\dot{N},\ i = 1, 2.$$

The dynamics governing change of engine speed are slower than the intake manifold dynamics. A good tradeoff between performance and simplicity is to retain $\alpha_1$ (slope) and neglect $\alpha_2$ (offset). With this simplification, the second derivative of $P_m$ is given by:

$$\ddot{P}_m = \frac{RT}{V}\left[\frac{d}{dt}MAF - \alpha_1\dot{P}_m - \dot{\alpha}_1 P_m\right].$$

To discretize the above equation, $dP_m(k)$ is defined as a discrete version of the time derivative of $P_m$, that is $dP_m(k)=(P_m(k+1)-P_m(k))/\Delta t$, to obtain $$dP_m(k+1) = \left(1 - \Delta t\alpha_1(N(k))\frac{RT}{V}\right)dP_m(k) + \frac{RT}{V}[MAF(k+1) - MAF(k)] - \frac{RT}{V}[\alpha_1(N(k+1)) - \alpha_1(N(k))]P_m(k)$$

Thus, we now have an equation defining the predicted rate of change of the intake manifold pressure one engine event into the future, block 122, which is used to determine the future values of intake manifold pressure, block 124. However, at time instant k, the signals from the next (k+1) instant are not available. To implement the right hand side, instead of its value at time k+1, we use the one event ahead predicted value of the MAF signal at time k, block 120, obtained by using the one event ahead prediction of the throttle position as follows:

$$MAF^{+1}(k) = \frac{P_{amb}}{P_{amb_nom}}\sqrt{\frac{T_{amb_nom}}{T_{amb}}}\,C(\theta^{+1}(k))Fn_subsonic\left(\frac{P_m(k) + \Delta t dP_m^{+1}(k-1)}{P_{amb}}\right)$$

where $P_{amb}$ and $P_{amb_nom}$ are current and nominal (i.e., 101 kPa.) absolute ambient pressures, $T_{amb}$ and $T_{amb_nom}$ are current and nominal (i.e., 300 K) absolute ambient temperatures, and $C(\theta)$ is the throttle sonic flow characteristic obtained from static engine data. Fn_subsonic is the standard subsonic flow correction $$Fnsubsonic = \begin{cases} \sqrt{14.96501\left[\left(\frac{P_{amb}}{P_{amb}}\right)^{1.42959} - \left(\frac{P_{amb}}{P_{amb}}\right)^{1.7148}\right]} & \text{if } \frac{P_m}{P_{amb}} \geq 0.52845 \\ 1.0 & \text{if } \frac{P_m}{P_{amb}} < 0.52845 \end{cases}$$

where $P_m(k)$ is the current measurement of intake manifold pressure, as shown at block 116. For in-vehicle implementation, the Fn_subsonic function can be implemented as a tabulated lookup function of the pressure ratio. In this case, the magnitude of the slope should be limited to prevent oscillatory behavior under wide open throttle conditions, possibly by extending the zero crossing of the function to a value of the pressure ratio slightly over 1.

Several different choices are available to obtain the quantity MAF(k), block 120, to be used in determining the future rate of change in the intake manifold pressure. The following formula, which uses the previous value of the predicted throttle position and current value of the manifold pressure, provides the best performance in terms of overshoot and stability at wide open throttle:

$$MAF(k) = \frac{P_{amb}}{P_{amb_nom}}\sqrt{\frac{T_{amb_nom}}{T_{amb}}}\,C(\theta^{+1}(k-1))Fn_subsonic\left(\frac{P_m(k)}{P_{amb}}\right)$$

To avoid predicting the engine speed, instead of subtracting the present value of $\alpha_1$ from its one step ahead prediction, we approximate $\alpha_1$ by subtracting the one event old value from the present. The above changes result in the $dP_m$ signal corresponding to the one event ahead predicted value of the time derivative of $P_m$, i.e., the rate of change of the future intake manifold pressure:

$$dP_m^{+1}(k) = \left(1 - \Delta t\alpha_1(N(k))\frac{RT}{V}\right)dP_m^{+1}(k-1) + \frac{RT}{V}[MAF^{+1}(k) - MAF(k)] - \frac{RT}{V}[\alpha_1(N(k)) - \alpha_1(N(k-1))]P_m(k)$$

Note that the value of $dP_m^{+1}(k)$ depends only on the signals available at time k. Hence, it can be used in the prediction of intake manifold pressure, block 124, as follows:

$$P_m^{+1}(k) = P_m(k) + \Delta t dP_m^{+1}(k-1)$$
$$P_m^{+2}(k) = P_m(k) + \Delta t dP_m^{+1}(k-1) + \Delta t dP_m^{+1}(k)$$

where $P_m^{+1}(k)$ and $P_m^{+2}(k)$ are one and two steps ahead predictions of the intake manifold pressure. The predicted values should be clipped so that they do not exceed the ambient pressure.

The prediction of the cylinder air charge, block 126, can then be obtained as:

$$M_{cyl}^{+1}(k) = \Delta t\left(\alpha_1(N(k))P_m^{+1}(k) + \alpha_2(N(k))\frac{P_{amb}}{P_{amb_nom}}\right)$$
$$M_{cyl}^{+2}(k) = \Delta t\left(\alpha_1(N(k))P_m^{+2}(k) + \alpha_2(N(k))\frac{P_{amb}}{P_{amb_nom}}\right)$$

At every engine event k, the value of $\theta^{+1}(k)$ is saved in the memory to be used in the next step as $\theta^{+1}(k-1)$ in computing MAF(k), blocks 128 and 130. What also needs to be saved are the values of $dP_m^{+1}(k)$ and $\alpha_1(N(k))$ which are used for the computation in the next event.

The above algorithm applies in the case when there is no exhaust gas recirculated into the intake manifold. If the EGR is provided internally via a variable cam timing mechanism, the algorithm described above stays the same except that the engine pumping coefficients $\alpha_1$ and $\alpha_2$ must also be adjusted for the current (measured) value of the cam phasing signal, that is, we use $\alpha_1(k)=\alpha_1(N(k),CAM(k))$ and $\alpha_2(k)=\alpha_2(N(k),CAM(k))$.

Figure 4:
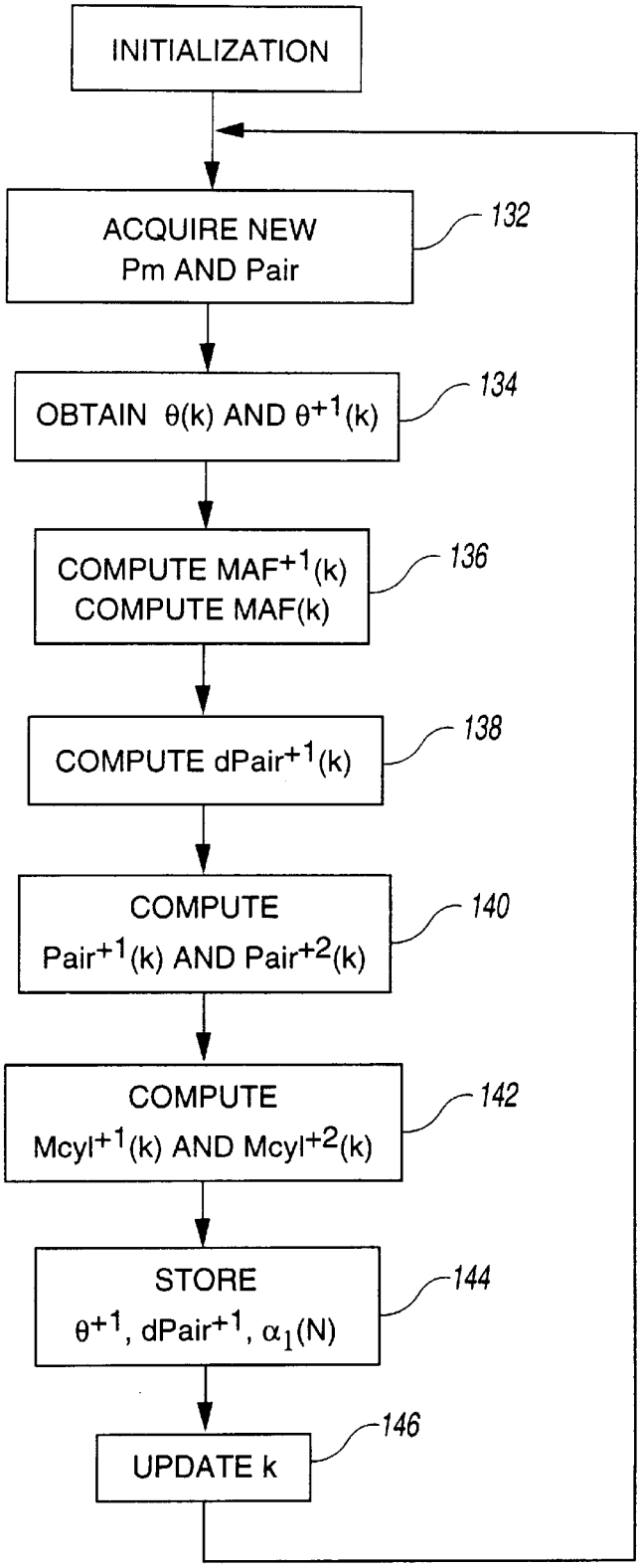
FIG. 4 is a flow diagram illustrating the general sequence of steps associated with determining the future cylinder air-charge of an engine having an external EGR.

FIG. 4 illustrates the general sequence of steps associated with determining future cylinder air charge if the exhaust gas is being recirculated in the intake manifold. In this case only a portion of the gas entering into the cylinder should be matched by fuel. Hence, the air charge anticipation algorithm has to be modified. We assume that one additional signal is available: the partial pressure of air in the intake manifold $P_{air}$. A known method for estimating the partial pressure of air is described in U.S. Patent application entitled "Method and System For Estimating Cylinder Air Flow", filed Jan. 12, 1998 and having Ser. No. 09/005,927. Thus, the current intake manifold pressure, current partial pressure of air, current throttle position and the predicted future throttle position are determined first, as shown at blocks 132 and 134.

The one-step ahead prediction of the throttle mass flow rate $MAF^{+1}(k)$, block 136, uses one-step ahead prediction of the throttle angle $\theta^{+1}(k)$ and the current value of intake manifold pressure modified by the previous value of the one-step ahead prediction for the derivative of the partial pressure of air:

$$MAF^{+1}(k) = \frac{P_{amb}}{P_{amb_nom}}\sqrt{\frac{T_{amb_nom}}{T_{amb}}}\,C(\theta^{+1}(k-1))Fn_subsonic\left(\frac{P_m(k)+\Delta t dP_{air}^{+1}(k-1)}{P_{amb}}\right)$$

As in the previous embodiment in which there is no recirculation of exhaust gas, MAF(k), block 136, is computed using the old predicted value of the throttle position and the current value of the intake manifold pressure as follows:

$$MAF(k) = \frac{P_{amb}}{P_{amb_nom}}\sqrt{\frac{T_{amb_nom}}{T_{amb}}}\,C(\theta^{+1}(k-1))Fn_subsonic\left(\frac{P_m(k)}{P_{amb}}\right)$$

The rate of change of the partial pressure of air, block 138, is then computed utilizing a recursive formula as follows:

$$dP_{air}^{+1}(k) = \left(1-\Delta t\alpha_1(N(k))\frac{RT}{V}\right)dP_{air}^{+1}(k-1) + \frac{RT}{V}[MAF^{+1}(k)-MAF(k)] - \frac{RT}{V}[\alpha_1(N(k))-\alpha_1(N(k-1))]P_{air}(k)$$

The one and two steps ahead predicted values of the partial pressure of air, block 140, are:

$$P_{air}^{+1}(k) = P_{air}(k) + \Delta t dP_{air}^{+1}(k-1)$$

$$P_{air}^{+2}(k) = P_{air}(k) + \Delta t dP_{air}^{+1}(k-1) + \Delta t dP_{air}^{+1}(k)$$

The prediction of the air cylinder-air charge, block 142, can then be obtained as:

$$M_{cyl}^{+1}(k) = \Delta t\left(\alpha_1(N(k))P_{air}^{+1}(k) + \alpha_2(N(k))\frac{P_{amb}}{P_{amb_nom}}\right)$$

$$M_{cyl}^{+2}(k) = \Delta t\left(\alpha_1(N(k))P_{air}^{+2}(k) + \alpha_2(N(k))\frac{P_{amb}}{P_{amb_nom}}\right)$$

Again, at every engine event k the values of $\theta^{+1}(k)$, $dP_{air}^{+1}(k)$, and $\alpha_1(N(k))$ are stored in memory to be used for the computation in the next event, as shown at blocks 144 and 146.

Although the steps shown in FIGS. 2–4 are depicted sequentially, they can be implemented utilizing interrupt-driven programming strategies, object-oriented programming, or the like. In a preferred embodiment, the steps shown in FIGS. 2–4 comprise a portion of a larger routine which performs other engine control functions.

While embodiments of the invention have been illustrated and described, it is not intended that these embodiments illustrate and describe all possible forms of the invention. Rather, it is intended that the following claims cover all modifications and alternative designs, and all equivalents, that fall within the spirit and scope of this invention.

What is claimed is:

1. A method for determining future cylinder air-charge of an internal combustion engine having a throttle plate for controlling the amount of air to be delivered to the engine and an intake manifold for receiving the air controlled by the throttle plate and for transferring the air into a cylinder, the method comprising:

sensing a current position of the throttle plate;

determining a future position of the throttle plate based on the sensed current position;

determining a model representing a rate of change in pressure of the intake manifold to reduce the effect of modeling errors in steady state operation; and determining the future cylinder air charge based on the future position of the throttle plate and the model.

2. The method as recited in claim 1 further comprising:

controlling the engine based on the future cylinder air charge.

3. The method as recited in claim 1 wherein determining the future position of the throttle plate comprises:

determining a previous position of the throttle plate; and determining a difference between the previous and current positions of the throttle plate.

4. The method as recited in claim 1 wherein determining the future cylinder air charge comprises:

determining a current pressure of the intake manifold;

determining a current rate of change of the pressure of the intake manifold based on the model; and determining a future pressure of the intake manifold based on the current rate of change.

5. The method as recited in claim 4 wherein determining the current rate of change comprises:

determining a current mass flow rate into the intake manifold; and determining a future mass flow rate into the intake manifold.

6. The method as recited in claim 5 wherein determining the future mass flow rate into the intake manifold comprises:

determining an ambient temperature;

determining an ambient pressure;

sensing the current pressure of the intake manifold; and determining a previous rate of change in the pressure of the intake manifold.

7. The method as recited in claim 1 wherein the engine further includes an exhaust manifold for emitting exhaust gas combusted by the engine and an exhaust gas recirculation (EGR) orifice for recirculating a portion of the exhaust gas into the intake manifold and wherein determining the future cylinder air charge includes determining a future partial pressure of air in the intake manifold.

8. The method as recited in claim 7 wherein determining the future partial pressure of air in the intake manifold comprises:

determining a current partial pressure of air in the intake manifold; and determining a current rate of change of the partial pressure of air in the intake manifold based on the model.

9. The method as recited in claim 8 wherein determining the current rate of change of the partial pressure of air comprises:

determining the current mass flow rate into the intake manifold;

determining the ambient temperature;

determining the ambient pressure;

sensing the current pressure of the intake manifold; and determining a previous rate of change in the partial pressure of air in the intake manifold.

10. A system for determining future cylinder air-charge of an internal combustion engine having a throttle plate for controlling the amount of air to be delivered to the engine and an intake manifold for receiving the air controlled by the throttle plate and for transferring the air into a cylinder, the system comprising:

a throttle position sensor for sensing a current position of the throttle plate; and control logic operative to determine a future position of the throttle plate based on the sensed current position, determine a model representing rate of change in pressure of the intake manifold to reduce the effect of modeling errors in steady state operation, and determine the future cylinder air charge based on the future position of the throttle plate and the model.

11. The system as recited in claim 10 wherein the control logic is further operative to control the engine based on the future cylinder air charge.

12. The system as recited in claim 10 wherein the control logic, in determining the future position of the throttle plate, is further operative to determine a previous position of the throttle plate and determine a difference between the previous and current positions of the throttle plate.

13. The system as recited in claim 10 wherein the control logic, in determining the future cylinder air charge, is further operative to determine a current pressure of the intake manifold, determine a current rate of change of the pressure of the intake manifold based on the model, and determine a future pressure of the intake manifold based on the current rate of change.

14. The system as recited in claim 13 wherein the control logic, in determining the current rate of change, is further operative to determine a current mass flow rate into the intake manifold and determine a future mass flow rate into the intake manifold.

15. The system as recited in claim 14 further comprising:

means for determining an ambient temperature;

means for determining ambient pressure;

a pressure sensor for sensing the current pressure of the intake manifold; and wherein the control logic, in determining the future mass flow rate into the intake manifold, is further operative to determine a previous rate of change in the pressure of the intake manifold based on the ambient temperature, ambient pressure and current pressure of the intake manifold.

16. The system as recited in claim 10 wherein the engine further includes an exhaust manifold for emitting exhaust gas combusted by the engine and an exhaust gas recirculation (EGR) orifice for recirculating a portion of the exhaust gas into the intake manifold and wherein the control logic, in determining the future cylinder air charge, is further operative to determine a future partial pressure of air in the intake manifold.

17. The system as recited in claim 16 wherein the control logic, in determining the future partial pressure of air in the intake manifold, is further operative to determine a current partial pressure of air in the intake manifold and determine a current rate of change of the partial pressure of air in the intake based on the model.

18. The system as recited in claim 17 wherein the control logic, in determining the current rate of change of the partial pressure of air, is further operative to determine the current mass flow rate into the intake manifold, determine the ambient temperature, determine the ambient pressure, determine the current pressure of the intake manifold, and determine a previous rate of change in the partial pressure of air in the intake manifold.

19. An article of manufacture for an automotive vehicle having an internal combustion engine having a throttle plate for controlling the amount of air to be delivered to the engine and an intake manifold for receiving the air controlled by the throttle plate and for transferring the air into a cylinder, the vehicle further having a throttle position sensor for sensing a current position of the throttle plate, the article of manufacture comprising:

a computer storage medium having a computer program encoded therein for determining a future position of the throttle plate based on the sensed current position, determining a model representing a rate of change in pressure of the intake manifold to reduce the effect of modeling errors in steady state operation, and determining the future cylinder air charge based on the future position of the throttle plate and the model.

20. The article of manufacture as recited in claim 19 wherein the engine further includes an exhaust manifold for emitting exhaust gas combusted by the engine and an exhaust gas recirculation (EGR) orifice for recirculating a portion of the exhaust gas into the intake manifold, wherein the computer program is further encoded therein for determining a future partial pressure of air in the intake manifold.

* * * * *